US010543999B2

(12) United States Patent
Furukawa et al.

(10) Patent No.: US 10,543,999 B2
(45) Date of Patent: Jan. 28, 2020

(54) SHEET CONVEYANCE APPARATUS AND IMAGE FORMING APPARATUS

(71) Applicant: CANON KABUSHIKI KAISHA, Tokyo (JP)

(72) Inventors: Tetsuo Furukawa, Kashiwa (JP); Tatsuo Nishiyama, Yokohama (JP); Shigeo Murayama, Susono (JP); Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/113,385

(22) Filed: Aug. 27, 2018

(65) Prior Publication Data

US 2019/0071271 A1 Mar. 7, 2019

(30) Foreign Application Priority Data

Sep. 7, 2017 (JP) ..... 2017-172421

(51) Int. Cl.
*B65H 29/58* (2006.01)
*B65H 9/00* (2006.01)
*B65H 5/06* (2006.01)

(52) U.S. Cl.
CPC ..... *B65H 9/004* (2013.01); *B65H 5/062* (2013.01)

(58) Field of Classification Search
CPC ..... B65H 2511/12; B65H 2511/10; B65H 29/58; B65H 29/60; B65H 2404/63; B65H 2404/632; B65H 31/26; B65H 2404/74; B65H 2404/7414
See application file for complete search history.

(56) References Cited

U.S. PATENT DOCUMENTS 7,742,736 B2 * 6/2010 Kobayashi ..... G03G 15/6529 271/226
9,463,947 B2 * 10/2016 Tahara ..... B65H 29/70
9,850,083 B2 12/2017 Nishiyama

FOREIGN PATENT DOCUMENTS

JP 2000-233873 A 8/2000
JP 2004-026343 A 1/2004
JP 2008-120484 A 5/2008
JP 2010155681 A * 7/2010
JP 2012111564 A * 6/2012

* cited by examiner

*Primary Examiner* — Luis A Gonzalez
(74) *Attorney, Agent, or Firm* — Venable LLP

(57) ABSTRACT

A sheet conveyance apparatus includes a conveyance portion, a reverse conveyance portion, and first and second conveyance regulating portions. An engagement portion contacts the first conveyance regulating portion so that it pivots in a first pivoting direction in an interlocked manner with the second conveyance regulating portion. The first and second conveyance regulating portions are arranged between the conveyance portion and the reverse conveyance portion in a first sheet conveyance direction, and an urging member urges the first and second conveyance regulating portions toward a position where the first and second conveyance regulating portions project to a first conveyance path through which the sheet conveyed from the conveyance portion toward the reverse conveyance portion is conveyed.

11 Claims, 7 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus configured to convey a sheet.

Description of the Related Art

Hitherto, a sheet conveyance apparatus configured to convey a plurality of sheets continuously and an image forming apparatus equipped with the same are known. Examples of products adopting this type of image forming apparatus include copying machines, facsimiles, printers such as laser printers and inkjet printers, scanner devices, plotters, printing machines, multifunction devices equipped with functions of a plurality of such devices, and OA apparatuses such as recording devices. According to sheet conveyance apparatuses of such image forming apparatuses, if a design is adopted in which components are arranged to efficiently use the dead space in a casing of the apparatus, a conveyance path through which the sheet is conveyed is often curved for downsizing and reducing the weight of the apparatus.

Some sheet conveyance apparatuses convey sheets serving as recording materials such as paper or plastic sheets before or after having images formed thereto, and some sheet conveyance apparatuses convey sheets, so-called document sheets, from which images are read. Hitherto, for example, a branching point of the conveyance paths or a reverse path in which a front side and a rear side of the sheet are reversed may be arranged near the curved conveyance path to perform duplex reading or duplex printing. A configuration is known where a conveyance regulation member, such as a component called a flapper, for controlling the conveyance destination of the sheet is arranged near the reverse path (refer for example to Japanese Patent Application Laid-Open Publication No. 2000-233873 described below).

According to the configuration of Japanese Patent Application Laid-Open Publication No. 2000-233873, a swing flapper for switching the conveyance destination of the sheet is divided into first and second swing flappers. The first swing flapper is fixed to a shaft and the second swing flapper is pivotably supported on the shaft, wherein the second swing flapper is swung through an interlocking mechanism composed of a contact portion and an elastic member. According to the configuration disclosed Japanese Patent Application Laid-Open Publication No. 2000-233873, the second swing flapper is pivoted both in normal and reverse pivoting directions by contact of the contact portion, and in one of the pivoting directions, the amount of pivoting movement is adjusted through the elastic member so as to absorb the thickness of the sheet being conveyed.

The swing flapper disclosed in Japanese Patent Application Laid-Open Publication No. 2000-233873 is used to perform switching control of the conveyance destination, wherein the flapper is not configured to pivot by contact with a leading edge of the sheet, and the flapper does not exert a skewing correcting ability. Therefore, it may be possible that the configuration of the swing flapper according to Japanese Patent Application Laid-Open Publication No. 2000-233873 is not suitable for arrangement at a conveyance position where skew correction is generally necessary, such as before discharging of the sheet to a sheet stacker or before conveying the sheet to a reverse path. In such conveyance position, if the leading edge of the sheet is skewed before reaching the flapper and the skewing of the sheet is not corrected, problems may occur, such as disorder in the state in which the sheet is supported on the sheet stacker, or deterioration of image forming accuracy on a second side, i.e., rear side, of the sheet having been reversed and conveyed. Further, in such a conveyance position, sheets having a variety of sheet widths may be conveyed, and therefore, skew correction of the sheets must be performed reliably even if sheets having a variety of sheet widths are conveyed.

SUMMARY OF THE INVENTION

According to a first aspect of the present invention, a sheet conveyance apparatus includes a conveyance portion configured to convey a sheet in a sheet conveyance direction, a conveyance regulation member arranged downstream of the conveyance portion in the sheet conveyance direction and including first and second conveyance regulating portions which are respectively supported pivotably at different positions in a width direction orthogonal to the sheet conveyance direction, and an engagement portion provided on one of the first and second conveyance regulating portions and configured to be engaged with the other of the first and second conveyance regulating portions. In a state where a sheet whose length in the width direction is a first width is conveyed through a conveyance path, the sheet abuts the first conveyance regulating portion and pivots only the first conveyance regulating portion, and in a state where a sheet whose length in the width direction is a second width that is greater than the first width is conveyed through the conveyance path, the sheet abuts the second conveyance regulating portion and pivots the second conveyance regulating portion while also pivoting the first conveyance regulating portion through the engagement portion.

According to a second aspect of the present invention, a sheet conveyance apparatus includes a conveyance portion configured to convey a sheet to a sheet conveyance direction, a first conveyance regulating portion configured to pivot toward a first pivoting direction by being in contact with a leading edge of a sheet conveyed through a conveyance path by the conveyance portion, a second conveyance regulating portion arranged in parallel with the first conveyance regulating portion in a width direction orthogonal to the sheet conveyance direction and configured to pivot toward the first pivoting direction by being in contact with the leading edge of the sheet conveyed through the conveyance path by the conveyance portion, and an engagement portion projected in the width direction from the second conveyance regulating portion toward the first conveyance regulating portion, and positioned upstream in the first pivoting direction than the first conveyance regulating portion. The engagement portion is configured to allow the first conveyance regulating portion to pivot to the first pivoting direction while separating from the second conveyance regulating portion, and configured to contact with the first conveyance regulating portion in a state where the second conveyance regulating portion pivots in the first pivoting direction, so that the first conveyance regulating portion pivots in the first pivoting direction in an interlocked manner with the second conveyance portion.

According to a third aspect of the present invention, a sheet conveyance apparatus includes a conveyance portion configured to convey a sheet to a sheet conveyance direction, a first conveyance regulating portion configured to pivot toward a first pivoting direction by being in contact with a leading edge of a sheet conveyed through the conveyance path by the conveyance portion, a second conveyance regulating portion arranged in parallel with the first conveyance regulating portion in a width direction orthogonal to the sheet conveyance direction and configured to pivot toward the first pivoting direction by being in contact with the leading edge of the sheet conveyed through the conveyance path by the conveyance portion, and an engagement portion projected in the width direction from the first conveyance regulating portion toward the second conveyance regulating portion, and positioned downstream in the first pivoting direction than the second conveyance regulating portion. The engagement portion allows the first conveyance regulating portion to pivot in the first pivoting direction while separating from the second conveyance regulating portion, and is into contact with the second conveyance regulating portion in a state where the second conveyance regulating portion pivots in the first pivoting direction, so that the first conveyance regulating portion pivots in the first pivoting direction in an interlocked manner with the second conveyance portion.

Further features of the present invention will become apparent from the following description of exemplary embodiments with reference to the attached drawings.

DESCRIPTION OF THE EMBODIMENTS

Now, embodiments for carrying out the present invention will be described with reference to the drawings. The following configurations are merely illustrated as examples, and detailed configurations can be varied arbitrarily within the scope of the present invention by those skilled in the art. Further, numerical values disclosed in the present embodiments are merely illustrated as exemplary values, and they are not intended to limit the scope of the invention.

First Embodiment

A preferred embodiment of an image forming apparatus according to a first embodiment of the present invention will be described with reference to the drawings. Now, we will first describe a general configuration of the image forming apparatus according to the present invention, and thereafter, describe the configuration of a conveyance regulation member of a sheet conveyance apparatus according to the present invention.

At first, we will describe an embodiment of a color laser beam printer adopting an electrophotographic system having a duplex image forming function to which the configurations of the sheet conveyance apparatus and the image forming apparatus according to the present invention are applied. Unless stated otherwise, the size, material, shape, relative arrangement and so on of components of the apparatus described as an example in the present embodiment are not intended to limit the scope of the present invention. Further, the configuration of the sheet conveyance apparatus according to the present invention is not restricted to color laser beam printers, and it can be applied to image forming apparatuses of other image forming systems such as an ink-jet system. Further, the configuration of the sheet conveyance apparatus according to the present invention is applicable not only to printers but to image forming apparatuses of other product categories, such as copying machines and facsimiles.

General Configuration of Image Forming Apparatus

Figure 2:
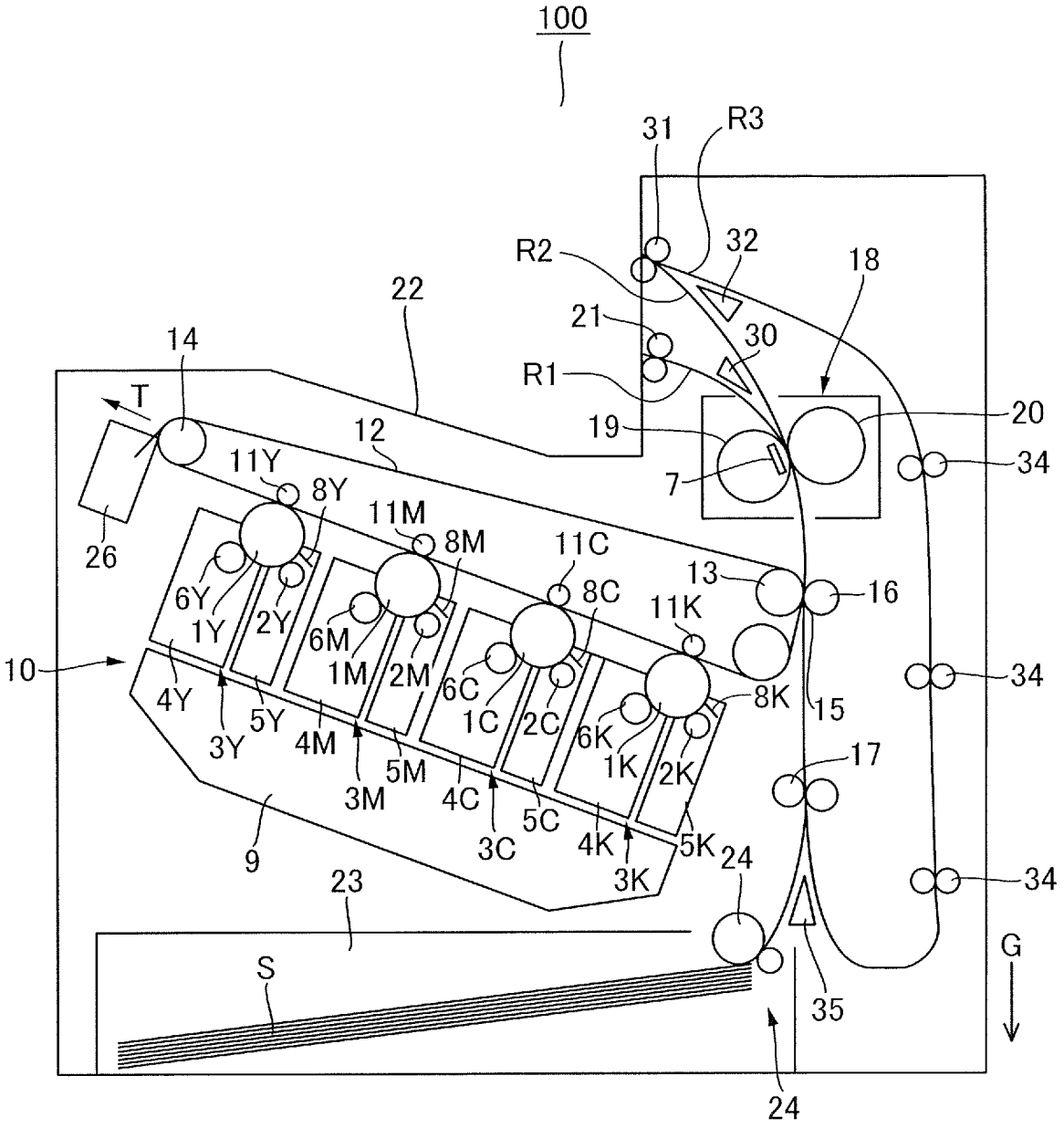
FIG. 2 is an explanatory view illustrating a general configuration of an image forming apparatus capable of implementing the present invention.

FIG. 2 schematically illustrates a cross-sectional configuration of a color laser beam printer that adopts an electrophotographic system having a duplex image forming function to which the configurations of the sheet conveyance apparatus and the image forming apparatus according to the present embodiment are applied. Arrow G illustrated on the lower right side of FIG. 2 indicates a vertical downward direction, and accordingly, the drawing is illustrated so that the vertical downward direction (G) matches the perpendicular downward direction. The same vertical downward direction (G) applies to FIGS. 3 A and 3B, FIG. 5B and FIG. 6B described later.

The image forming apparatus of FIG. 2 is generally composed of an image forming and processing portion, a cleaning unit, a sheet feeding unit, a secondary transfer portion, a fixing and discharging portion and a duplex conveyance portion. The respective portions will be described below.

Image Forming and Processing Portion

An image forming apparatus body 100 illustrated in FIG. 2 comprises process cartridges 3Y, 3M, 3C and 3K that are detachably attached to the apparatus body. The four process cartridges 3Y, 3M, 3C and 3K adopt the same configuration, but they respectively form images using different colored toners, such as yellow (Y), magenta (M), cyan (C) and black (K). Hereafter, the respective toner colors may be referred to by reference characters Y, M, C and K or a suffix thereof.

The process cartridges 3Y, 3M, 3C and 3K are composed of developing units 4Y, 4M, 4C and 4K and cleaner units 5Y, 5M, 5C and 5K. The developing units 4Y, 4M, 4C and 4K include developing rollers 6Y, 6M, 6C and 6K. Meanwhile, the cleaner units 5Y, 5M, 5C and 5K include photosensitive drums 1Y, 1M, 1C and 1K serving as image bearing members, charge rollers 2Y, 2M, 2C and 2K, drum cleaning blades 8Y, 8M, 8C and 8K, and a waste toner container (not shown).

A scanner unit 9 is arranged at a vertical downward direction of the process cartridges 3Y, 3M, 3C and 3K, and based on image signals, exposure scanning is performed to the photosensitive drums 1Y, 1M, 1C and 1K. The photosensitive drums 1Y, 1M, 1C and 1K are charged to predetermined negative potential by the charge rollers 2Y, 2M, 2C and 2K, and electrostatic latent images are formed by the scanner unit 9. The electrostatic latent images are then subjected to reversal development by the developing units 4Y, 4M, 4C and 4K, and negative toner is adhered, by which toner images of yellow, magenta, cyan and black are formed on the surface of respective drums by the respective developing units.

An intermediate transfer belt unit 10 includes an intermediate transfer belt 12 stretched around a drive roller 13 and a tension roller 14. Predetermined tension is applied from the tension roller 14 to the intermediate transfer belt 12 in the direction of arrow T. The photosensitive drums 1Y, 1M, 1C and 1K are respectively driven to rotate in a clockwise direction, and the intermediate transfer belt 12 is driven to rotate in a counterclockwise direction. Further, primary transfer rollers 11Y, 11M, 11C and 11K are arranged on an inner side of the intermediate transfer belt 12 opposed to the respective photosensitive drums 1Y, 1M, 1C and 1K, and transfer bias is applied thereto by a bias applying unit not shown.

By applying positive polarity bias to the primary transfer rollers 11Y, 11M, 11C and 11K, toner images on the respective drum surfaces are sequentially primarily transferred in the named order from the photosensitive drums 1Y, 1M, 1C and 1K to the intermediate transfer belt 12. Thereafter, the four color toner images transferred in a superposed manner to the intermediate transfer belt 12 are conveyed to a secondary transfer portion 15. Then, the color toner images are transferred at the secondary transfer portion 15 to a sheet S serving as a recording material. Generally, a sheet S serving as a recording material is composed of materials such as paper and plastic.

Cleaning Unit

The toner remaining on the surface of the photosensitive drums 1Y, 1M, 1C and 1K after transferring toner images are removed by the drum cleaning blades 8Y, 8M, 8C and 8K. Further, toner remaining on the intermediate transfer belt 12 after secondary transfer to the sheet S is removed by an intermediate transfer belt cleaning device 26 and collected in a waste toner collecting container (not shown).

Sheet Feeding Unit

The sheet feeding unit is composed of a sheet feed roller 24 attached to an image forming apparatus body 100 and a sheet feed cassette 23 serving as a sheet cassette detachably attached to the image forming apparatus body 100.

The sheet feed roller 24 is rotated by power provided from a sheet feed drive unit not shown. The sheet feed drive unit is fixed to the image forming apparatus body 100, and it is equipped with a drive or transmission mechanism such as a gear. One sheet S is fed at a time from the sheet feed cassette 23 by the power from the sheet feed drive unit, and a leading edge of the sheet S being fed is abutted against a nip portion of a registration roller pair 17 whose rotation is stopped at this point of time. The registration roller pair 17 is configured to perform final correction of skewing of the sheet S and match the timing of conveyance of the sheet with the writing of image at the image forming unit.

Secondary Transfer Portion

The sheet S fed from the sheet feeding unit is conveyed by the registration roller pair 17 to the secondary transfer portion 15. At the secondary transfer portion 15, positive polarity bias is applied to a secondary transfer roller 16, by which a four color toner image on the intermediate transfer belt 12 is secondarily transferred to the sheet S being conveyed.

Fixing and Discharging Portion

A fixing unit 18 configured to fix a toner image of multiple colors transferred to the sheet S includes a fixing film 19 serving as a fixing member heated by a heater 7 serving as a heating unit, and a pressure roller 20 serving as a pressing member that comes into pressure contact with the fixing film 19. The sheet S is guided by an entrance guiding member not shown, introduced to a fixing nip portion which is a pressure contact portion between the fixing film 19 and the pressure roller 20, and nipped and conveyed by the fixing nip portion where heat and pressure necessary for the toner to be fixed is applied. Thereby, toner images of multiple colors are mixed and melted and fixed as full color image on the surface of the sheet S.

The sheet S conveyed from the fixing unit 18 is introduced to a conveyance path R1 by a switching member 30 and conveyed to a sheet discharge roller pair 21 where the sheet S is discharged onto a sheet support tray 22 provided on an upper surface of the printer body.

Duplex Conveyance Portion

In duplex image forming mode or duplex recording mode, the following conveyance control of the sheet S is performed. The sheet S having an image already recorded on one side thereof in the above-described manner is introduced by the switching member 30 to a conveyance path R2, passed through a conveyance regulation member 32 and conveyed by a switchback roller pair 31 to a discharge direction. Thereafter, at a timing when the sheet S reaches a predetermined position where a trailing edge portion of the sheet S has passed the conveyance regulation member 32 but has not passed through a nip portion of the switchback roller pair 31, the switchback roller pair 31 is controlled to rotate in a reverse direction. Thereby, the sheet S having an image formed on one side thereof is subjected to switchback and conveyed into the printer. The sheet S subjected to switchback conveyance passes the upper side of the conveyance regulation member 32 and enters a conveyance path R3. Thereafter, the sheet S is conveyed through the conveyance path R3 by duplex conveyance roller pairs 34, 34 and so on toward a lower side of the drawing, guided by a conveyance regulation member 35 and conveyed again to the registration roller pair 17 with the front and rear sides thereof reversed.

Thereafter, similar to the above-described one-side image forming operation, the registration roller pair 17 corrects skewing of the sheet and matches the timing of sheet conveyance with the forming of image at the image forming unit, and a four-color toner image is secondarily transferred by the secondary transfer portion 15. Then, the sheet S is introduced to the fixing unit 18 again, passed through a similar conveyance path as described earlier, and the sheet S having images formed on both first and second sides thereof is discharged by the switchback roller pair 31 to the support tray 22. In this case, naturally, the reverse rotation control of the switchback roller pair 31 is not performed. According to the present embodiment, a conveyance portion configured to convey a sheet toward the conveyance regulation member 32 is configured by the fixing film 19 and the pressure roller 20 of the fixing unit 18 described earlier. Further, a reverse conveyance portion configured to rotate in normal and reverse directions is arranged on a downstream side in a sheet conveyance direction than the conveyance portion by the switchback roller pair 31.

Detailed Configuration of Conveyance Regulation Member

Figure 1:
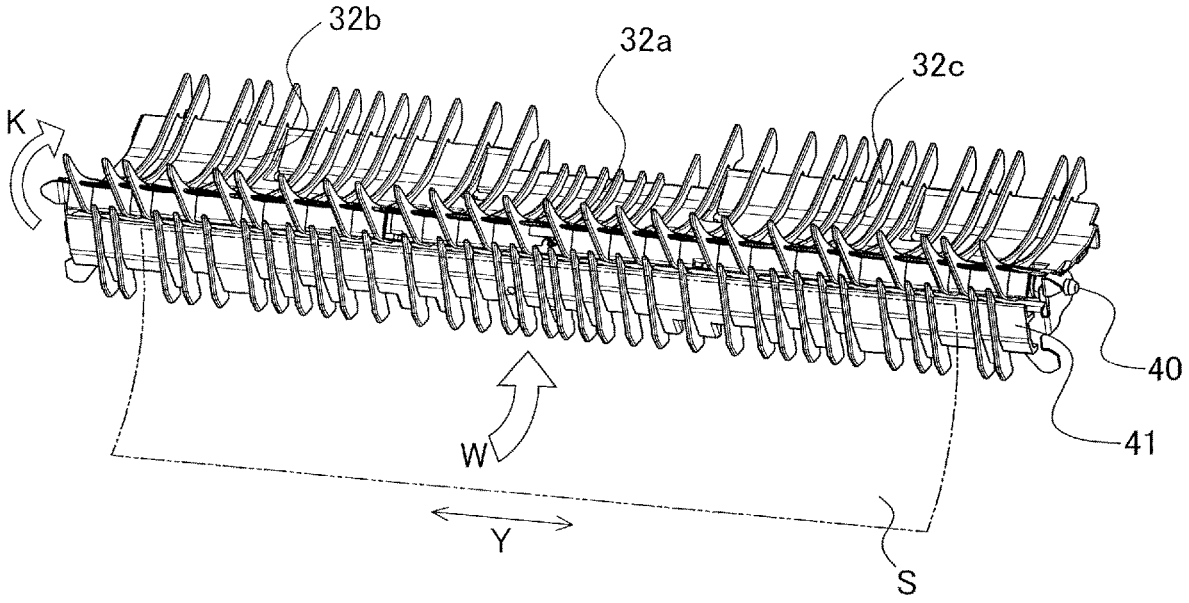
FIG. 1 is an explanatory view illustrating a conveyance regulation member and a sheet according to a first embodiment of the present invention.

Next, a configuration of the conveyance regulation member 32 of the sheet conveyance apparatus according to the present embodiment will be described in detail with reference to FIG. 1, FIGS. 3A and 3B and FIG. 4. FIG. 1 illustrates the conveyance regulation member 32 and the state of the sheet S being conveyed in perspective view. FIG. 4 illustrates a configuration of the conveyance regulation member 32 and a lower side of a guide 41. Further, FIGS. 3A and 3B illustrate a cross-sectional structure of an approximately center portion of the conveyance regulation member 32 and the guide 41 taken near line C-C of FIG. 4 (the same applies for FIG. 5B and FIG. 6B described later).

Figure 3A:
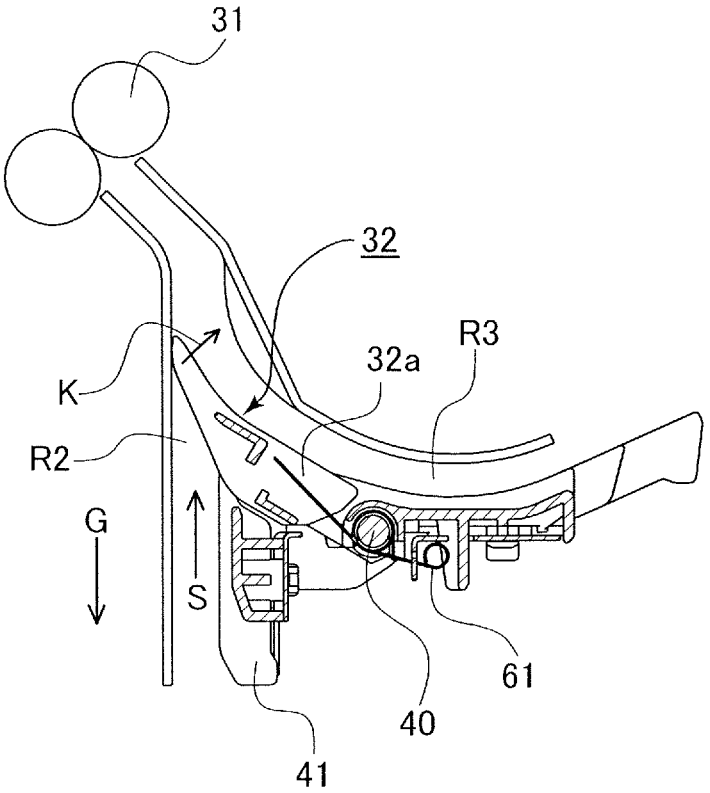
FIG. 3A is a cross-sectional view illustrating a state in which the conveyance regulation member is positioned at a standby position.
Figure 3B:
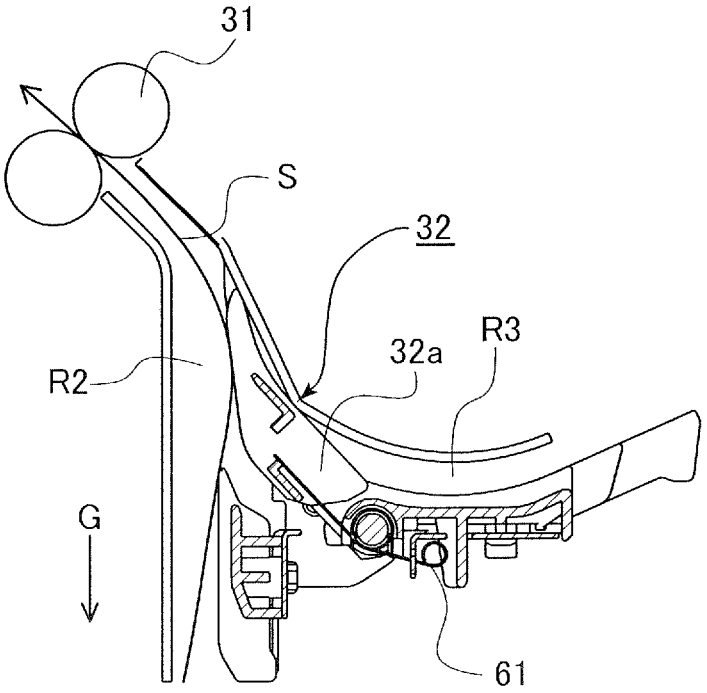
FIG. 3B is a cross-sectional view illustrating a state in which the conveyance regulation member is pushed up from the standby position by the sheet.
Figure 4:
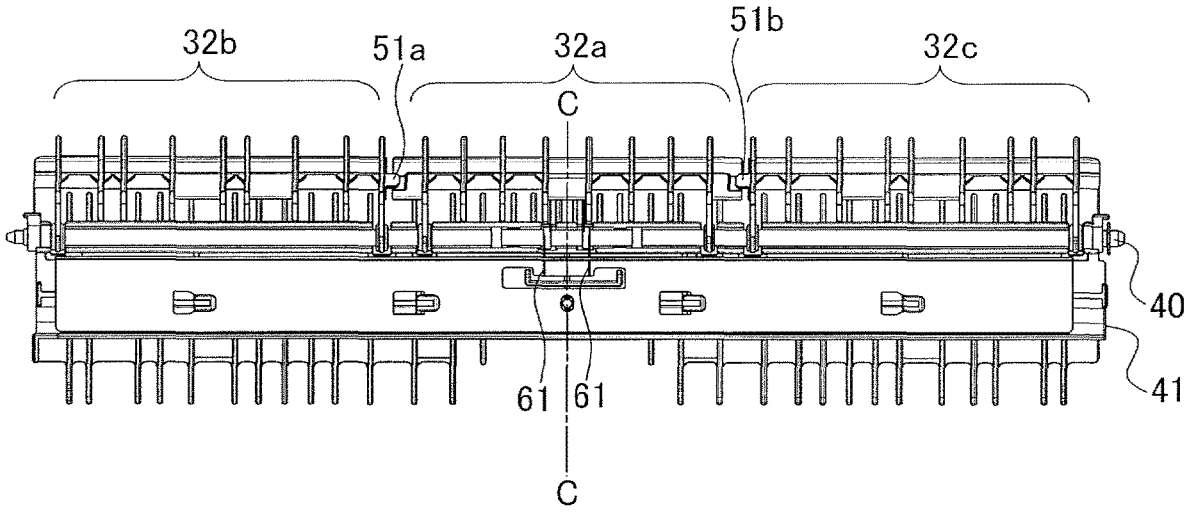
FIG. 4 is an explanatory view illustrating a configuration of a lower side of the conveyance regulation member according to the first embodiment of the present invention.

FIG. 1 and FIGS. 3A and 3B illustrate a state in which the sheet S conveyed through the conveyance path R2 is passed through the position of the conveyance regulation member 32. That is, the sheet S conveyed from the fixing unit 18 through the conveyance path R2 contacts and pushes up a lower surface of the conveyance regulation member 32 positioned at a standby position illustrated in FIG. 3A, pivots the conveyance regulation member 32 in the direction of arrow K as illustrated in FIG. 3B to open the path, and is conveyed to the switchback roller pair 31. At this time, as illustrated in FIG. 1, lower surfaces of a large number of ribs approximately having the same shapes and arranged along a width direction of the sheet S of the conveyance regulation member 32 contact the leading edge of the sheet S, by which the sheet S is curved (W) and proceeds while forming a loop. Thereby, skew correction of the sheet S is performed.

According to the present embodiment, as illustrated in FIGS. 1 and 4, the conveyance regulation member 32 is divided into multiple conveyance regulating portions 32*a*, 32*b* and 32*c* with respect to a width direction Y orthogonal to the sheet conveyance direction. The plurality of conveyance regulating portions 32*a*, 32*b* and 32*c* of the conveyance regulation member 32 is axially pivotably supported by a shaft 40 that passes through the conveyance regulating portions 32*a*, 32*b* and 32*c*, and the shaft 40 serves as the center of rotation of the conveyance regulation member 32. The shaft 40 of the regulation member is formed, for example, of a steel material subjected to appropriate surface treatment.

The conveyance regulation member 32 and the guide 41 are arranged at a position where the conveyance paths R2 and R3 are merged or branched. The conveyance regulating portions 32*a*, 32*b* and 32*c* of the conveyance regulation member 32 and the guide 41 are configured with a large number of ribs for guiding the sheet S arranged as guide portions on curved upper and lower edge portions, for example, as illustrated in FIG. 1. The conveyance regulating portions 32*a*, 32*b* and 32*c* of the conveyance regulation member 32 and the guide 41 may be formed integrally, for example, through injection molding of resin material.

The guide 41 constitutes a portion of a guide surface of the conveyance path R2, as illustrated in FIGS. 3A and 3B. The conveyance regulation member 32 contacts the sheet S conveyed through the conveyance path R2 and performs skew control of the sheet S, as illustrated in FIG. 3B. In this state, as illustrated in FIG. 3B, the conveyance regulation member 32 contacts the sheet S conveyed through the conveyance path R2 and pivots by conveyance force of the sheet S against urging force of a spring 61 described later. A pivot position of the conveyance regulation member 32 illustrated in FIG. 3B corresponds to a first pivot position retreated from the conveyance path R2.

Meanwhile, in a standby state where the sheet S in the conveyance path R2 has not reached the position of the conveyance regulation member 32, the conveyance regulation member 32 takes the pivot position as illustrated in FIG. 3A. That is, as illustrated in FIG. 3A, the conveyance regulation member 32 takes a pivot position where the conveyance regulation member 32 is in contact with a positioning portion, the detail of which is not illustrated, at an upper portion of the guide 41 by its own weight and by pivot urging force in a counterclockwise direction, that is, direction opposed to arrow K, applied from the spring 61 arranged as an urging member. The pivot position of the conveyance regulation member 32 illustrated in FIG. 3A corresponds to a second pivot position where the conveyance regulation member 32 projects to the conveyance path R2 and blocks the conveyance path R2 by its lower edge.

Thereby, in a state where the sheet S pushes up and passes the conveyance regulation member 32, the conveyance regulation member 32 takes the first pivot position illustrated in FIG. 3B. After the trailing edge of the sheet S passes the position of the conveyance regulation member 32, the conveyance regulation member 32 pivots in a direction opposite to the arrow K by its own weight and the spring force of the spring 61 and returns to the standby state where it takes the second pivot position illustrated in FIG. 3A. In the standby state (second pivot position) of the conveyance regulation member 32, the sheet conveyed in the opposite direction from the switchback roller pair 31 passes the upper side of the conveyance regulation member 32 and is guided toward the conveyance path R3.

That is, the conveyance regulation member 32 is arranged at a merging portion between the fixing unit 18 and the switchback roller pair 31 in the sheet conveyance direction where the first conveyance path R2 through which the sheet conveyed from the fixing unit 18 toward the switchback roller pair 31 is conveyed is merged with the second conveyance path R3 through which the sheet reversed and conveyed by the switchback roller pair 31 is conveyed. The conveyance regulation member 32 is projected to the first conveyance path R1 and urged by the urging member 61 to a position guiding the sheet subjected to reverse conveyance by the switchback roller pair 31 to the second conveyance path R3.

Next, the configuration and operation of the conveyance regulation member according to the present invention will be described in further detail with reference to FIGS. 4, 5 and 6.

As illustrated in FIG. 1 and in FIG. 4 illustrating a lower view thereof, the conveyance regulation member 32 according to the present embodiment adopts a configuration where the conveyance regulation member 32 is divided into a plurality of conveyance regulating portions 32*a*, 32*b* and 32*c* with respect to the width direction Y orthogonal to a conveyance direction of the sheet S. That is, the conveyance regulation member 32 is composed of the conveyance regulating portion 32*a* arranged at a center portion in the width direction Y and the conveyance regulating portions 32*b* and 32*c* arranged at both sides thereof in the width direction Y, wherein the conveyance regulating portions 32*a*, 32*b* and 32*c* are axially supported pivotally on a common shaft 40. However, depending on the specification of the apparatus, the conveyance regulating portions 32*a*, 32*b* and 32*c* are not necessarily axially supported on the same or common shaft.

In the present embodiment, a conveyance regulating portion 32*a* arranged at a center is referred to as a first conveyance regulating portion, and conveyance regulating portions 32*b* or 32*c* arranged on both sides thereof are referred to as a second conveyance regulating portion. In other words, according to the present embodiment, the conveyance regulating portion 32*a* serves as the first conveyance regulating portion that contacts the leading edge of the sheet conveyed through the conveyance path and pivots toward the first pivoting direction. Further, the conveyance regulating portion 32*b* serves as a first regulation unit arranged on one side in the width direction of the conveyance regulating portion 32*a* serving as the first conveyance regulating portion, and the conveyance regulating portion 32*c* serves as a second regulation unit arranged on the other side in the width direction of the first conveyance regulating portion. According to the present embodiment, the conveyance regulating portions 32*b* and 32*c* constitute the second conveyance regulating portion that is arranged in parallel with the conveyance regulating portion 32*a* in the width direction orthogonal to the sheet conveyance direction, contact the leading edge of the sheet conveyed through the conveyance path and pivot toward the first pivoting direction.

Then, as illustrated in FIG. 4, an engagement portion 51*a* is arranged between the conveyance regulating portion 32*a*, i.e., first conveyance regulating portion, and the conveyance regulating portion 32*b*, i.e., second conveyance regulating portion. Further, an engagement portion 51*b* is arranged between the conveyance regulating portion 32*a*, i.e., first conveyance regulating portion, and the conveyance regulating portion 32*c*, i.e., second conveyance regulating portion. In the present embodiment, the engagement portions 51*a* and 51*b* are configured as engagement claw-shaped members that are projected from the conveyance regulating portions 32*b* and 32*c*, i.e., second conveyance regulating portion, and enter the lower side of the conveyance regulating portion 32*a*, i.e., first conveyance regulating portion.

In the present embodiment, the engagement portion 51*a* can be referred to as a first projected portion that is projected in the width direction from the conveyance regulating portion 32*b* serving as the first regulation unit toward the conveyance regulating portion 32*a* serving as the first conveyance regulating portion and contacts the conveyance regulating portion 32*a*. Further, the engagement portion 51*b* can be referred to as a second projected portion that is projected in the width direction from the conveyance regulating portion 32*c* serving as the second regulation unit toward the conveyance regulating portion 32*a* and contacts the conveyance regulating portion 32*a*. The present embodiment constitutes an engagement portion in which the first and second projected portions 51*a* and 51*b* allow the first conveyance regulating portion to separate from the second conveyance regulating portion and pivot to the first pivoting direction, and in a state where the second conveyance portion pivots to the first pivoting direction, the engagement portion contacts the first conveyance regulating portion and pivots the first conveyance portion to the first pivoting direction in an interlocked manner with the second conveyance portion.

The above-described engagement portions 51*a* and 51*b* are engagement portions that are arranged on either the conveyance regulating portion 32*a*, i.e., the first conveyance regulating portion, or the conveyance regulating portions 32*b* and 32*c*, i.e., the second conveyance regulating portion, and configured to engage with the other conveyance regulating portion. Then, in a state where the sheet contacts the first conveyance regulating portion (32*a*) or the second conveyance regulating portions (32*b*, 32*c*) and pivots the conveyance regulating portion, the engagement structures of the engagement portions 51*a* and 51*b* transmit the pivoting force in the following manner. That is, according to this engagement structure, the pivoting force caused by contact of the sheet S is not transmitted from the first conveyance regulating portion (32*a*) to the second conveyance regulating portions (32*b*, 32*c*), and it is only transmitted from the second conveyance regulating portions (32*b*,32*c*) to the first conveyance regulating portion (32*a*).

Further, as illustrated in FIG. 4, the conveyance regulating portion 32*a*, i.e., first conveyance regulating portion, is urged to pivot, for example, by springs 61 and 61 serving as urging members wound around the shaft 40 to a standby state, i.e., second pivot position illustrated in FIG. 3A. In the configuration illustrated in FIG. 4, there are two springs 61 and 61 serving as urging members disposed on the conveyance regulating portion 32*a*, but the number of springs 61 being disposed can be selected arbitrarily as long as required urging force is generated according to the weight of the conveyance regulating portions 32*a* through 32*c*.

The pivot urging force is transmitted from the conveyance regulating portion 32*a*, i.e., first conveyance regulating portion, through the engagement structure of the engagement portions 51*a* and 51*b* to the second conveyance regulating portions (32*b*, 32*c*). The second conveyance regulating portions (32*b*, 32*c*) are pivotable between a third pivot position retreated from the conveyance path R2 and a fourth pivot position, i.e., standby position, projected to the conveyance path R2. The engagement structure of the engagement portions 51*a* and 51*b* functions as an engagement structure for transmitting the pivot urging force of the spring 61, i.e., urging member, from the first conveyance regulating portion (32*a*) to the second conveyance regulating portions (32*b*, 32*c*). That is, the pivot urging force of the spring 61, i.e., urging member, is transmitted through the engagement portions 51*a* and 51*b* in a direction urging the second conveyance regulating portions (32*b*, 32*c*) toward a fourth pivot position, i.e., standby position, where the second conveyance regulating portions (32*b*, 32*c*) are projected to the conveyance path R2.

Figure 7:
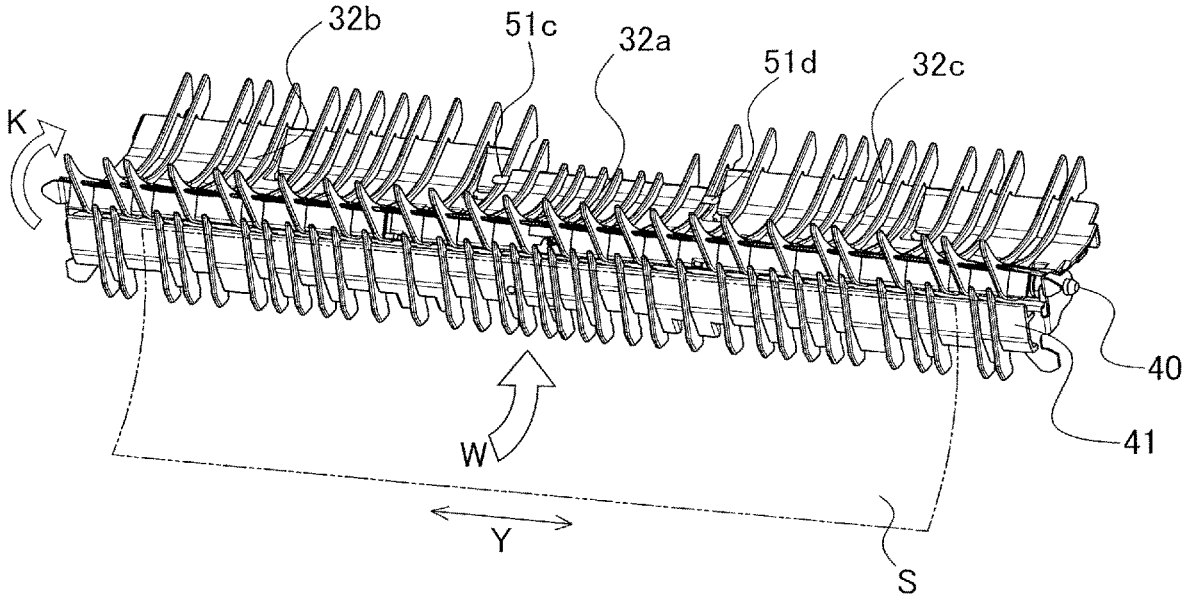
FIG. 7 is a perspective view illustrating a modified example of the conveyance regulating portion.

The engagement structure of the above-described engagement portions is not necessarily realized by the engagement members of the engagement portions being projected from the sides of the conveyance regulating portions 32*b* and 32*c*, i.e., second conveyance regulating portions, and extended to the lower surface side of the conveyance regulating portion 32*a*, i.e., first conveyance regulating portion, as illustrated in FIG. 4. For example, as illustrated in FIG. 7, the engagement portions 51*c* and 51*d* can be composed of engagement claw-shaped members that are arranged on the sides of the conveyance regulating portion 32*a*, i.e., first conveyance regulating portion, and extended to the upper surface side of the conveyance regulating portions 32*b* and 32*c*, i.e., second conveyance regulating portions. The engagement structure of the engagement portions that realizes the transmission state of the above-described pivoting force or the pivot urging force is not restricted to the above-described configuration, and the configuration can be modified arbitrarily by those skilled in the art.

That is, the engagement portions can be configured as engagement portions 51*c* and 51*d* that are projected in the width direction from the first conveyance regulating portion to the second conveyance regulating portion and positioned downstream in the first pivoting direction than the second conveyance regulating portion. In this case, the engagement portions 51*c* and 51*d* allow the first conveyance regulating portion to separate from the second conveyance regulating portions and pivot in the first pivoting direction, and in a state where the second conveyance portions pivot in the first pivoting direction, the engagement portions 51*c* and 51*d* contact the second conveyance regulating portions and pivot the first conveyance portion in an interlocked manner with the second conveyance portions to the first pivoting direction. In this case, the above-described engagement portion 51*c* may be referred to as a third projected portion that is projected in the width direction toward the first regulation unit 32*b* and comes into contact with the first regulation unit 32*b* while the engagement portion 51*d* may be referred to as a fourth projected portion that is projected in the width direction toward the second regulation unit 32*c* and comes into contact with the second regulation unit 32*c*.

The following conveyance control becomes possible by the divided structure of the conveyance regulation member 32 composed of the conveyance regulating portion 32*a*, i.e., first conveyance regulating portion, and the conveyance regulating portions 32*b* and 32*c*, i.e., second conveyance regulating portions, and by the engagement structure of the engagement portions 51*a* and 51*b*. That is, according to the width in the width direction Y of the sheet S being conveyed, the conveyance regulating portion 32*a*, i.e., first conveyance regulating portion, or the conveyance regulating portions 32*b* and 32*c*, i.e., second conveyance regulating portions, are selected to contact the sheet S and perform conveyance regulation.

Figure 5A:
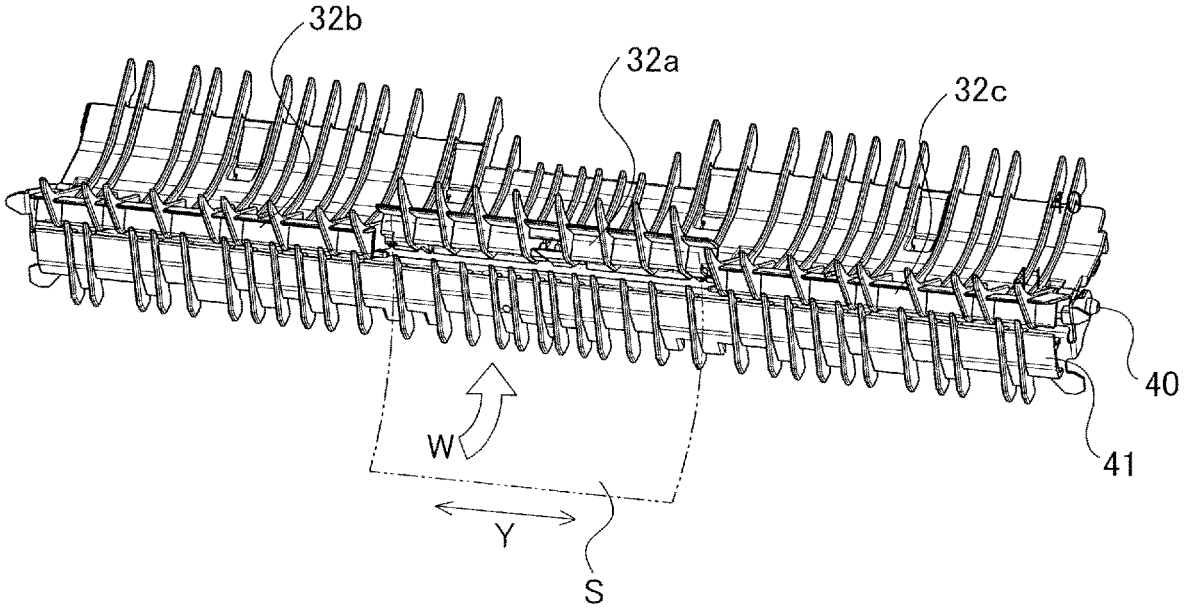
FIG. 5A is a perspective view of the conveyance regulation member illustrating a state where a sheet having a narrow width is conveyed.
Figure 5B:
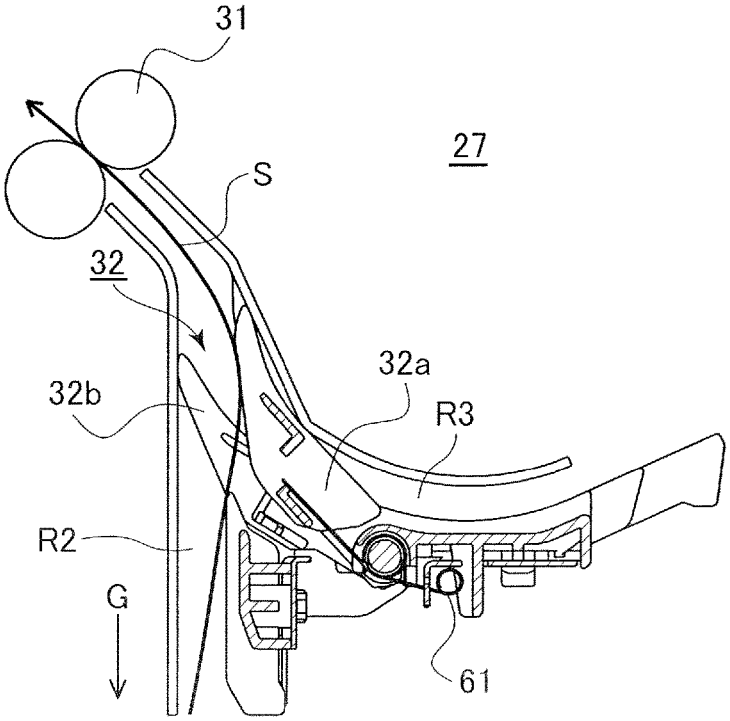
FIG. 5B is a cross-sectional view of the conveyance regulation member illustrating a state where a sheet having a narrow width is conveyed.

FIGS. 5A and 5B illustrate the operation of the conveyance regulation member 32 in a state where the width corresponding to the width direction Y of the sheet S being conveyed through the conveyance path R2 is a small size, i.e., first width, that is narrower than the conveyance regulating portion 32*a*. In a state where the sheet S passes the conveyance regulation member 32 arranged facing the conveyance path R2, since the width direction Y of the sheet S is narrower than the conveyance regulating portion 32*a*, only the conveyance regulating portion 32*a* pivots from the pivot position projected to the conveyance path R2, i.e., second pivot position. As described, engagement portions 51*a* and 51*b* are arranged between the conveyance regulating portion 32*a*, i.e., first conveyance regulating portion, and the conveyance regulating portions 32*b* and 32*c*, i.e., second conveyance regulating portions, wherein the engagement structure transmits pivoting force only from the conveyance regulating portion 32*b* or 32*c* to the conveyance regulating portion 32*a*. Therefore, the sheet S pushes up only the conveyance regulating portion 32*a* against the urging force of the spring 61 and passes the position of the conveyance regulating portion 32*a*. At this time, as illustrated by the arrow W of FIG. 5A or the cross-sectional view of FIG. 5B, the sheet S is curved by having the leading edge or the area close to the leading edge of the sheet S contact the conveyance regulating portion 32*a* within the space of the conveyance path R2, and proceeds while forming a loop. At this time, if the sheet S is skewed, the skewing is gradually corrected.

Figure 6A:
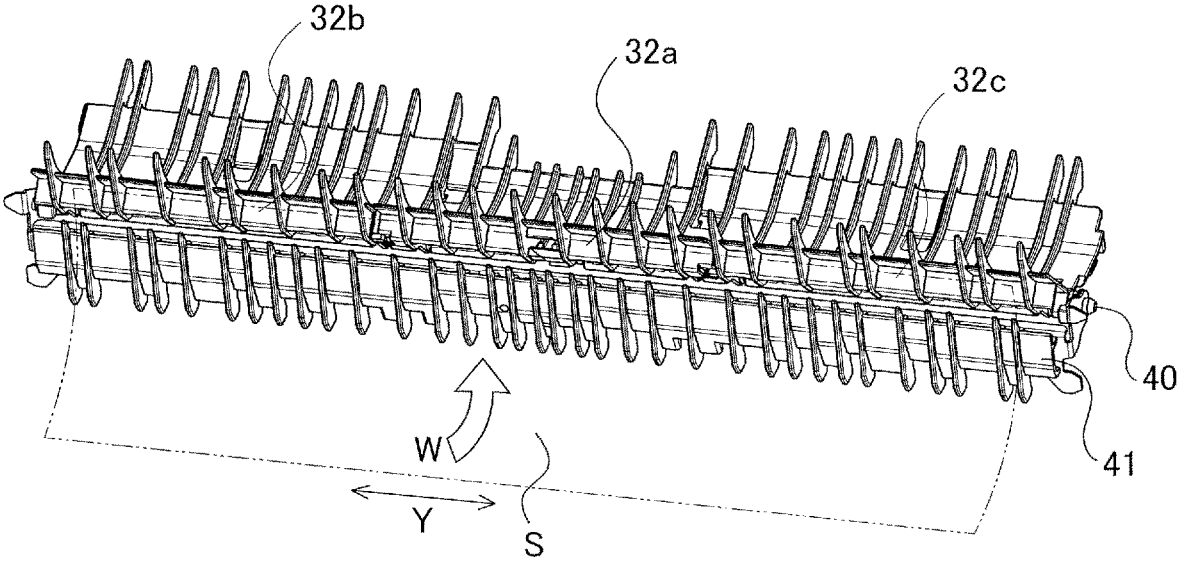
FIG. 6A is a perspective view of the conveyance regulation member illustrating a state where a sheet having a wide width is conveyed.
Figure 6B:
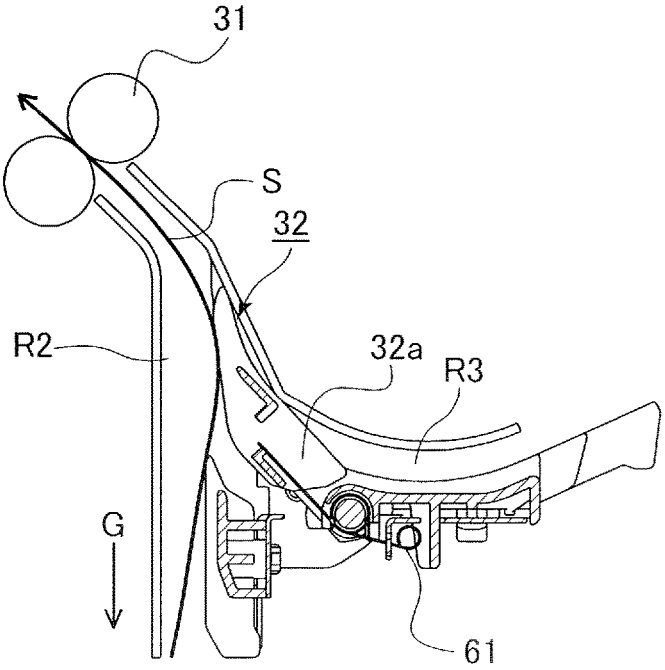
FIG. 6B is across-sectional view of the conveyance regulation member illustrating a state where a sheet having a wide width is conveyed.

Meanwhile, FIGS. 6A and 6B illustrate the operation of the conveyance regulation member 32 in a state where the width in the width direction Y of the sheet S conveyed through the conveyance path R2 is a large size, i.e., second width, that is wider than the conveyance regulating portion 32*a*. During conveyance of such a sheet S, the width direction Y of the sheet S is wider than the conveyance regulating portion 32*a*, such that when the sheet S passes the conveyance regulation member 32, the conveyance regulating portions 32*a*, 32*b* and 32*c* pivot from the pivot position projected to the conveyance path R2, i.e., second pivot position.

Now, if the sheet S is conveyed without being skewed with respect to the conveyance regulation member 32, the sheet S pushes up all the conveyance regulating portions 32*a*, 32*b* and 32*c* simultaneously. If the sheet S is skewed, and for example, if the sheet S is conveyed in a skewed manner with the conveyance regulating portion 32*b* side preceding with respect to the conveyance regulation member 32, at first, the conveyance regulating portion 32*b* will be pushed up by the leading side of the sheet S. Then, the conveyance regulating portion 32*b* pushes up the conveyance regulating portion 32*a* through the engagement portion 51*a*. However, while a small portion of the leading edge of the sheet S contacts the conveyance regulating portion 32*c*, there may be a period of time when the contact force of the sheet S is not sufficient for the conveyance regulating portion 32*b* to push up the conveyance regulating portion 32*a* through the engagement portion 51*a*. That is, during this period, the pivot urging force of the spring 61 urging the conveyance regulating portion 32*a* through the engagement portion 51*a* is applied to the conveyance regulating portion 32*b* in addition to the own weight of the conveyance regulating portion, which is greater than the contact force of the sheet S. During this period, the leading portion of the sheet S is curved (W) and gradually forms a loop, and the contact force with respect to the conveyance regulating portion 32*b* is gradually increased. Then, if the contact force of the leading portion of the sheet S applied to the conveyance regulating portion 32*b* or 32*a* becomes sufficiently strong to push up the conveyance regulating portion 32*b*, the engagement portion 51*a* and the conveyance regulating portion 32*a*, the conveyance regulating portion 32*b* pushes up the conveyance regulating portion 32*a* through the engagement portion 51*a*. Finally, the conveyance regulating portion 32*c* is pushed up by the leading edge of the delayed side of the sheet S.

If skewing in an opposite direction as the above-described direction has occurred to the sheet S, at first, the conveyance regulating portion 32*c* is pushed up by the leading side of the sheet S. Then, the conveyance regulating portion 32*c* pushes the conveyance regulating portion 32*a* through the engagement portion 51*b*. However, while a small portion of the leading edge of the sheet S contacts the conveyance regulating portion 32*c*, there may be a period of time when the contact force of the sheet S is not sufficient for the conveyance regulating portion 32*c* to push up the conveyance regulating portion 32*a* through the engagement portion 51*b*. That is, during this period, the pivot urging force of the spring 61 urging the conveyance regulating portion 32*a* through the engagement portion 51*b* is applied to the conveyance regulating portion 32*c* in addition to the own weight of the conveyance regulating portion, which is greater than the contact force of the sheet S. During this period, the leading portion of the sheet S is curved (W) and gradually forms a loop, and the contact force with respect to the conveyance regulating portion 32*c* is gradually increased. Then, if the contact force of the leading portion of the sheet S applied to the conveyance regulating portion 32*c* or 32*a* becomes sufficiently strong to push up the conveyance regulating portion 32*c*, the engagement portion 51*b* and the conveyance regulating portion 32*a*, the conveyance regulating portion 32*c* pushes up the conveyance regulating portion 32*a* through the engagement portion 51*b*. Finally, the conveyance regulating portion 32*b* is pushed up by the leading edge of the delayed side of the sheet S.

In any case, if the sheet S is skewed, the sheet S cannot pass the position of the conveyance regulation member 32 unless all the conveyance regulating portions 32*a*, 32*b* and 32*c* are completely pushed up at the same time. While the conveyance regulating portions 32*a*, 32*b* and 32*c* are not completely pushed up at the same time, skewing of the sheet S is corrected by the conveyance force of the sheet S, the weight of the whole conveyance regulation member 32 received by the leading edge of the sheet S and the urging force of the spring 61. Specifically, a pivot urging force is applied to the conveyance regulating portion 32*a* (and 32*b* and 32*c* through the engagement portions 51*a* and 51*b*) from the spring 61 in a direction projecting the conveyance regulating portion 32*a* to the conveyance path R2. Therefore, the whole conveyance regulation member 32, that is, the conveyance regulating portions 32*a*, 32*b* and 32*c*, will not pivot to open the conveyance path R2 unless the contact force at the leading edge area of the sheet S exceeds a certain value. Then, mainly the whole of the conveyance regulation member 32, that is, the conveyance regulating portions 32*a*, 32*b* and 32*c*, are integrated, and appropriate skew feed correction is performed to the sheet S passing the conveyance regulation member 32 while the conveyance regulation member 32 pivots to retreat from the conveyance path R2.

Effect of the Present Embodiment

As described, according to the conveyance regulation member 32 of the first embodiment, the conveyance regulating portions 32*a*, 32*b* and 32*c* are either respectively pivoted to correspond to the necessary width range of the sheet S being conveyed or integrated in accordance with the necessary width range and pivoted. Thereby, sheet conveyance control including the switching of conveyance paths and correction of skewing of the sheet is enabled.

That is, in a state where the sheet S pushes up and passes the conveyance regulation member 32 that is divided into multiple parts in the width direction Y, the range of the conveyance regulation member 32 pushed up is varied according to the width of the sheet S, and efficient skew correction of the sheet S is performed. Now, in a configuration where the whole conveyance regulation member 32 is integrated, for example, the skew correcting ability is considered to be improved by increasing the weight thereof and the spring force applying the pivoting load thereto. However, the force of a small sized sheet S having a narrow sheet width to push up the conveyance regulation member 32 is weak, so that if the weight of the conveyance regulation member 32 or the spring force is set too high, the sheet may be jammed. According to the present embodiment adopting a configuration where the range of the conveyance regulation member 32 being pushed up is varied according to the width of the sheet S, efficient skew correction of the sheet S is enabled. Further, in order to realize skew correction, it may be possible to arrange components or mechanisms for correcting skew feed of the sheet in addition to the conveyance regulation member, but in that case, the cost of the apparatus is increased inevitably. However, according to the conveyance regulation member 32 of the present embodiment, there is no need to provide an additional member for skew correction, and the present embodiment enables to perform appropriate conveyance control and skewing correction by a relatively inexpensive configuration.

In a state where the sheet is first passed through the conveyance regulation member 32 and then reverse-conveyed by the switchback roller pair 31 to be conveyed again to the conveyance path R3, the conveyance regulation member 32 must be returned infallibly to the standby position, i.e., second pivot position. If the timing for returning the conveyance regulation member 32 to the standby position is delayed, jamming may occur by the sheet S being conveyed to an erroneous conveyance path or the like. One method for avoiding this problem is to delay the timing in which the sheet S is subjected to switchback, for example, by delaying the reverse-drive of the switchback roller pair 31 for a period of time to allow the conveyance regulation member 32 to return to the standby position, i.e., second pivot position, without fail. However, this delay in timing may elongate the overall time required to subject the sheet S to image processing. Meanwhile, according to the present embodiment, the spring 61 for urging the conveyance regulating portion 32*a* to pivot to the standby position, i.e., second pivot position, is provided, and the pivot urging force is transmitted through the engagement portion 51*a* and 51*b* to the conveyance regulating portions 32*b* and 32*c*. Therefore, according to the present embodiment, all the conveyance regulating portions 32*a*, 32*b* and 32*c* can be returned reliably and speedily to the standby position, i.e., second pivot position by simply arranging the spring 61 serving as the urging member only with respect to the conveyance regulating portion 32*a*. That is, according to the present embodiment, by merely adopting a simple and inexpensive configuration of arranging the spring 61 serving as the urging member only to the conveyance regulating portion 32*a*, a speedy sheet conveyance control and image formation processing are enabled without setting an extra delay time for reverse conveyance of the sheet S.

Modified Example

The above embodiment illustrated a configuration where the conveyance regulating portion 32*a* positioned approximately at the center in the width direction Y of the sheet S is pivotable between a first pivot position retreated from the conveyance path R2 and a second pivot position, i.e., standby position, projected to the conveyance path R2. Further, the springs 61 (and 61) are arranged as the urging member for urging the conveyance regulating portion 32*a* positioned approximately at the center in the width direction Y of the sheet to pivot toward the second pivot position, i.e., standby position. It is also possible to adopt a configuration without the spring 61 serving as the urging member by appropriately setting the weight of the conveyance regulating portions 32*a*, 32*b* and 32*c*, where (only) the conveyance regulation member 32 is used to correct skewing of the sheet S and switching of conveyance paths.

According to the configuration illustrated above, the sheet S having a narrow width, i.e., first width, is conveyed at the center portion of the conveyance path R2, as illustrated in FIGS. 5A and 5B, and only the first conveyance regulation portion (32*a*) arranged at the center portion of the conveyance path R2 is pivoted by the contact force of the sheet. If a sheet S having a wider width, i.e., second width, is conveyed, the second conveyance regulating portions (32*b* and 32*c*) on both sides of the conveyance path R2 are pivoted in addition to the first conveyance regulating portion (32*a*) pivoted through the engagement portions 51*a* and 51*b*.

However, the arrangement of the first conveyance regulating portion (32*a*) and the second conveyance regulating portions (32*b* and 32*c*) at the center or both outer side portions of the conveyance path (R2) can be varied arbitrarily according to the specification of the image forming apparatus and the sheet conveyance apparatus. For example, some image forming apparatuses may adopt a conveyance specification where various sized sheets S are conveyed in a side-referenced manner. In that case, a sheet S having a narrow width is conveyed at a side-referenced position where the sheet is arranged on one side in the conveyance path (R2). According to a sheet conveyance apparatus adopting such one side-referenced conveyance, the above-described first conveyance regulating portion (32*a*) is arranged on one end side in the conveyance path (R2), and the second conveyance regulating portion (such as 32*b*) can be arranged adjacent thereto in the center portion side of the conveyance path (R2). Further, the second conveyance regulating portion (such as 32*b*') that pivots when a sheet having a greater width contacts the same can be arranged adjacent to the second conveyance regulating portion (such as 32*b*).

In the case of such one side-referenced conveyance, the conveyance regulation member 32 can be divided into more than three parts. For example, it may be possible to arrange the first conveyance regulating portion (32*a*) at one side end portion of the conveyance path (R2) and sequentially arrange multiple second conveyance regulating portions (32*b*, 32*b*' 32*b*" and so on) that pivot when a sheet having a wider sheet width contacts the same adjacent to the first conveyance regulating portion. Similar to the above-described example, the engagement portion that interlocks the respective conveyance regulating portions may be designed as an engagement structure that sequentially transmits contact force of the sheet from the second conveyance regulating portion that pivots when a wider sheet is conveyed toward the first conveyance regulating portion (such as from 32*b*" to 32*b*', to 32*b*, and then to 32*a*). Even according to the above-described configuration, similar to the above-described example, the conveyance regulating portions covering the necessary width range are suitably integrally pivoted to perform sheet conveyance control such as switching of conveyance paths and skew correction of the sheet.

The above-described embodiment illustrates a configuration where the conveyance regulation member 32 serving as the conveyance regulation member is arranged to face the conveyance path R2 and the position of the conveyance regulation member 32 corresponds to the area where a plurality of conveyance paths R2 and R3 are merged or branched. However, the configuration similar to the above-described conveyance regulation member 32 can be adopted in the switching member 30 that is arranged at a position where the conveyance paths R2 and R1 are branched, as illustrated in FIG. 2, for example. In that case, skewing of the sheet S discharged onto the support tray 22 can be corrected, and the sheet S can be discharged and stacked in an aligned manner on the support tray 22.

According to the above-described configuration, the sheets conveyed through the conveyance regulation member 32 are recording paper or plastic sheets and the like on which an image has been formed. However, the configuration of the conveyance regulation member 32 can also be applied to the sheet conveyance apparatus that coveys conveys document sheets to be read by a scanner and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-172421, filed Sep. 7, 2017, which is hereby incorporated by reference herein in its entirety.

What is claimed is:

1. A sheet conveyance apparatus comprising:

a conveyance portion configured to convey a sheet in a first sheet conveyance direction;

a reverse conveyance portion arranged downstream of the conveyance portion in the first sheet conveyance direction and configured to convey the sheet in a second sheet conveyance direction opposite to the first sheet conveyance direction;

a first conveyance regulating portion configured to pivot toward a first pivoting direction by being in contact with a leading edge of the sheet conveyed through a first conveyance path by the conveyance portion;

a second conveyance regulating portion arranged in parallel with the first conveyance regulating portion in a width direction orthogonal to the first sheet conveyance direction and configured to pivot toward the first pivoting direction by being in contact with the leading edge of the sheet conveyed through the first conveyance path by the conveyance portion;

an engagement portion positioned more upstream in the first pivoting direction than the first conveyance regulating portion, the engagement portion being configured to allow the first conveyance regulating portion to pivot to the first pivoting direction while separating from the second conveyance regulating portion, and configured to contact with the first conveyance regulating portion in a state where the second conveyance regulating portion pivots in the first pivoting direction, so that the first conveyance regulating portion pivots in the first pivoting direction in an interlocked manner with the second conveyance regulating portion; and an urging member configured to urge the first conveyance regulating portion to a second pivoting direction that is opposite from the first pivoting direction, wherein the first and second conveyance regulating portions are arranged between the conveyance portion and the reverse conveyance portion in the first sheet conveyance direction, and the urging member is configured to urge the first and second conveyance regulating portions toward a position where the first and second conveyance regulating portions project to the first conveyance path through which the sheet conveyed from the conveyance portion toward the reverse conveyance portion is conveyed.

2. The sheet conveyance apparatus according to claim 1, wherein the second conveyance regulating portion comprises a first regulation unit arranged on one side of the first conveyance regulating portion in the width direction and a second regulation unit arranged on the other side of the first conveyance regulating portion in the width direction, and the engagement portion comprises a first projected portion that is projected from the first regulation unit toward the first conveyance regulating portion so as to overlap with the first conveyance regulating portion when viewed in the first pivoting direction, and a second projected portion that is projected from the second regulation unit toward the first conveyance regulating portion so as to overlap with the first conveyance regulating portion when viewed in the first pivoting direction.

3. The sheet conveyance apparatus according to claim 1, wherein the first and second conveyance regulating portions are arranged at a merging portion where the first conveyance path merges with a second conveyance path through which the sheet reversed by the reverse conveyance portion is conveyed, and the first and second conveyance regulating portions are urged by the urging member toward the position where the first and second conveyance regulating portions project to the first conveyance path and guide the sheet reversed and conveyed by the reverse conveyance portion toward the second conveyance path.

4. An image forming apparatus comprising:

the sheet conveyance apparatus according to claim 1; and an image forming unit configured to form an image on a sheet.

5. The sheet conveyance apparatus according to claim 1, wherein the first conveyance regulating portion is arranged at a center portion of the first conveyance path with respect to the width direction, and the second conveyance regulating portion is arranged farther from the center portion of the first conveyance path with respect to the width direction than the first conveyance regulating portion.

6. The sheet conveyance apparatus according to claim 1, wherein the urging member is a spring.

7. A sheet conveyance apparatus comprising:

a conveyance portion configured to convey a sheet in a first sheet conveyance direction;

a first conveyance regulating portion configured to pivot toward a first pivoting direction by being in contact with a leading edge of a sheet conveyed through a conveyance path by the conveyance portion;

a second conveyance regulating portion arranged in parallel with the first conveyance regulating portion in a width direction orthogonal to the first sheet conveyance direction and configured to pivot toward the first pivoting direction by being in contact with the leading edge of the sheet conveyed through the conveyance path by the conveyance portion; and an engagement portion projected in the width direction from the first conveyance regulating portion toward the second conveyance regulating portion, and positioned more downstream in the first pivoting direction than the second conveyance regulating portion, wherein the engagement portion allows the first conveyance regulating portion to pivot in the first pivoting direction while separating from the second conveyance regulating portion, and is in contact with the second conveyance regulating portion in a state where the second conveyance regulating portion pivots in the first pivoting direction, so that the first conveyance regulating portion pivots in the first pivoting direction in an interlocked manner with the second conveyance portion, the second conveyance regulating portion comprises a first regulation unit arranged on one side of the first conveyance regulating portion in the width direction and a second regulation unit arranged on the other side of the first conveyance regulating portion in the width direction, and the engagement portion comprises a third projected portion that is projected toward the first regulation unit so as to overlap with the first regulation unit when viewed in the first pivoting direction, and a fourth projected portion that is projected toward the second regulation unit so as to overlap with the second regulation unit when viewed in the first pivoting direction.

8. The sheet conveyance apparatus according to claim 7, further comprising an urging member configured to urge the first conveyance regulating portion to a second pivoting direction that is opposite from the first pivoting direction.

9. An image forming apparatus comprising:

the sheet conveyance apparatus according to claim 7; and an image forming unit configured to form an image on a sheet.

10. A sheet conveyance apparatus, comprising:

a conveyance portion configured to convey a sheet in a sheet conveyance direction;

a reverse conveyance portion arranged downstream of the conveyance portion in the sheet conveyance direction and configured to rotate in normal and reverse directions;

a first conveyance regulating portion configured to pivot toward a first pivoting direction by being in contact with a leading edge of a sheet conveyed through a conveyance path by the conveyance portion;

a second conveyance regulating portion arranged in parallel with the first conveyance regulating portion in a width direction orthogonal to the sheet conveyance direction and configured to pivot toward the first pivoting direction by being in contact with the leading edge of the sheet conveyed through the conveyance path by the conveyance portion;

an engagement portion projected in the width direction from the first conveyance regulating portion toward the second conveyance regulating portion, and positioned downstream in the first pivoting direction from the second conveyance regulating portion; and an urging member configured to urge the first conveyance regulating portion to a second pivoting direction that is opposite from the first pivoting direction, wherein the first and second conveyance regulating portions are arranged at a merging portion between the conveyance portion and the reverse conveyance portion in the sheet conveyance direction, where a first conveyance path through which a sheet conveyed from the conveyance portion toward the reverse conveyance portion is conveyed merges with a second conveyance path through which the sheet reversed by the reverse conveyance portion is conveyed, and the first and second conveyance regulating portions are urged by the urging member toward a position where the first and second conveyance regulating portions project to the first conveyance path and guide the sheet reversed and conveyed by the reverse conveyance portion toward the second conveyance path.

11. An image forming apparatus comprising:

the sheet conveyance apparatus according to claim 10; and an image forming unit configured to form an image on a sheet.

* * * * *